US006784619B2

(12) United States Patent
Choi

(10) Patent No.: US 6,784,619 B2
(45) Date of Patent: Aug. 31, 2004

(54) ELECTRODELESS LIGHTING SYSTEM

(75) Inventor: Joon-Sik Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/142,953

(22) Filed: May 13, 2002

(65) Prior Publication Data

US 2003/0085671 A1 May 8, 2003

(30) Foreign Application Priority Data

Nov. 7, 2001 (KR) ..... 2001-69196

(51) Int. Cl.[7] ..... H01J 65/04
(52) U.S. Cl. ..... 315/39.51; 315/248; 315/118
(58) Field of Search ..... 315/39, 118, 248, 315/267, 39.51, 39.53, 344

(56) References Cited

U.S. PATENT DOCUMENTS 4,673,846 A * 6/1987 Yshizawa et al. ..... 315/248
5,998,934 A * 12/1999 Mimasu et al. ..... 315/118
6,049,170 A * 4/2000 Hochi et al. ..... 315/39
6,137,237 A * 10/2000 MacLennan et al. ..... 315/248

* cited by examiner

*Primary Examiner*—Jimmy T Vu
(74) *Attorney, Agent, or Firm*—Fleshner & Kim, LLP

(57) ABSTRACT

An electrodeless lighting system which is emitting light using microwave generated in a magnetron comprises: a main case including a waveguide through which microwave is transmitted, a resonator coupled to an exit of the waveguide, and a bulb located in the resonator; a subsidiary case including a magnetron generating the microwave, and a high voltage generator for providing the magnetron with high voltage; and a microwave transmission cable connected from the magnetron to the waveguide for transmitting the microwave, whereby the emitting portion can be minimized by separating components which are not really needed for emitting, and lowering of performance and damage of the bulb or the resonator by infiltration of impurities such as dust can be prevented.

34 Claims, 3 Drawing Sheets

ELECTRODELESS LIGHTING SYSTEM

BACKGROUND OF THE INVENTION

1. Field of the Invention

The present invention relates to an electrodeless lighting system, and particularly, to an electrodeless lighting system which generates light using microwave generated from a magnetron.

2. Description of the Background Art

Generally, an electrodeless lighting system is a device for emitting visible rays or ultraviolet rays by applying microwave to an electrodeless lamp, and therefore, has longer life span than that of incandescent lamp or fluorescent lamp which is generally used, and has higher lighting effect.

FIG. 1 is a longitudinal cross-sectional view showing a general electrodeless lighting system according to the conventional art.

As shown therein, the conventional electrodeless lighting system comprises a high voltage generator 2 for transforming utility AC power to high voltage, and a magnetron 3 for generating microwave using the high voltage generated from the high voltage generator 2 in a case 1.

In addition, a waveguide 4 for guiding the microwave generated from the magnetron 3 is fixed inside the case 1 between the magnetron 3 and the high voltage generator 2 so as to be exposed to outside through an opening portion 1*a* formed on the case 1.

A bulb 6 in which a material emitted by the microwave energy is filled is located on an exit side of the waveguide 4. Also, a shaft through hole 4*a* is formed on intermediate part of the waveguide 4, and a rotation shaft 5 which is coupled to the bulb 6 passes through the shaft through hole 4*a*. A bulb motor 7 is installed on bottom side of the waveguide 4 so as to make the bulb rotate by the rotation shaft and prevent the bulb 6 from being heated locally.

In addition, a resonator 8 of metal screen, which is covered on outer side of the bulb 6 for blocking the leakage of the microwave transmitted from the magnetron 3 and for passing the light emitted from the bulb 6, is installed on an exit side of the waveguide 4 which is located on front side of the case 1.

A reflector 9 is fixed on front side of the case 1 for reflecting the light generated from the bulb 6 and passed the resonator 8.

Also, a cooling device 13 is installed on rear side of the case 1 so as to cool down the magnetron 3 and the high voltage generator 2. The cooling device 13 comprises a fan housing 12 including discharge ports 12*a* and a suction port 12*b*, a fan motor 10, and a cooling fan 11.

A plurality of exhaust holes 1*b* are formed on front side of the case 1 so that the air sucked through the suction port 12*b* cools down the high voltage generator 2 and the magnetron 3 and then is discharged to outside of the case 1.

The operation of the conventional electrodeless lighting system described above will be described as follows.

When the electric power is applied, the high voltage generator 2 generates high voltage, and the microwave is generated in the magnetron 3 by the generated high voltage.

The microwave generated as above is transmitted into the resonator 8 through the waveguide 4, then, the material filled in the bulb 6 is discharged by the microwave and generates light by the plasma, and the light is illuminated to frontward as reflected by the reflector 9.

In addition, when the light is generated from the bulb 6, the bulb motor 7 is rotated at a predetermined speed to rotate the bulb 6 so as to prevent the bulb 6 from being heated locally.

At the same time, the cooling fan 11 is rotated by the operation of the fan motor 10, and accordingly, the outside air sucked through the fan housing 12 cools down the high voltage generator 2 and the magnetron 3, after that, the air is discharged to outside of the case 1 through the exhaust holes 1*b* formed on front side of the case 1.

However, according to the conventional electrodeless lighting system, only the bulb 6, the resonator 8 and etc. are really needed to emitting light, however, almost all the components are installed inside the case 1, and therefore the volume of the lighting system is increased and takes a large space when it is installed. And it may be very difficult to apply the lighting system in case that the installation space is small.

Also, according to the conventional electrodeless lighting system, if the air is induced into the components such as the resonator 8 through the gap of the assembled components during the process of blasting the air when the cooling device is operated in order to cool down the high voltage generator 2 and the magnetron 3, impurities such as dust or bugs induced with the air may oxidize the components of the resonator 8 and etc. or decrease the function of the components by the high temperature around the bulb 6, whereby the life span of the lighting system may be decreased.

SUMMARY OF THE INVENTION

Therefore, an object of the present invention is to provide an electrodeless lighting system suitable for minimizing an emitting part by separating the order parts which are not virtually needed to emit from the emitting part.

Another object of the present invention is to provide an electrodeless lighting system by which performance degradation and damage of a bulb which may be generated by the impurities such as dust can be prevented by preventing the air which is forcedly blasted in the cooling device from inducing into the components.

To achieve these and other advantages and in accordance with the purpose of the present invention, as embodied and broadly described herein, there is provided an electrodeless lighting system comprising: a main case including a waveguide through which a microwave is transmitted, a resonator coupled to an exit of the waveguide, and a bulb located inside the resonator; a subsidiary case including a magnetron for generating the microwave, and a high voltage generator for providing the magnetron with high voltage; and a microwave transmission cable connected from the magnetron to the waveguide for transmitting the microwave.

The main case is sealed except a part where the exit of the waveguide is exposed.

The subsidiary case includes a cooling device in order to cool down the magnetron and the high voltage generator.

In addition, the subsidiary case includes a suction hole and a discharge hole for circulating outside air, and the cooling device comprises a cooling fan for forcedly circulating the outside air inside the subsidiary case and a fan motor for driving the fan motor.

Also, to achieve the objects of the present invention, there is provided an electrodeless lighting system comprising: a main case including a magnetron for generating the microwave, a waveguide for transmitting the microwave, and a resonator coupled to an exit of the waveguide, and a bulb located inside the resonator; a subsidiary case including a high voltage generator for providing the magnetron with the high voltage; and a coaxial cable connected from the high voltage generator to the magnetron for transmitting the high voltage.

The main case includes a separating plate for dividing into an area where the magnetron is installed and an area where the waveguide is installed.

A cooling device is installed on the area where the magnetron is installed so as to cool down the magnetron.

A suction hole and a discharge hole are formed in the main case on the area where the magnetron is installed so as to circulate the outside air, and the cooling device includes a cooling fan for forcedly circulating outside air into the main case, and a fan motor driving the fan motor.

The main case including the waveguide is sealed.

The subsidiary case includes a ventilation hole so that the outside air can be induced.

The electrodeless lighting system constructed above, the components which are heating such as the magnetron and the high voltage generator are installed inside the subsidiary case with the cooling device, and the components which are necessarily needed to emit the light such as the bulb, the resonator, and the waveguide are installed in the main case which is installed separately with the subsidiary case. Thereby, only the emitting portion for emitting the light can be installed, and the size of the device can be reduced. Therefore, it can be easily installed, and has higher appearance when the installation is completed.

Also, the heating components and the emitting portion are separately installed in respective cases, or the air blasted from the cooling device is blocked so as not to be induced into the emitting portion, and thereby erosion on the resonator and the bulb caused by the dust induced with the outside air which is introduced into the emitting portions can be prevented.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
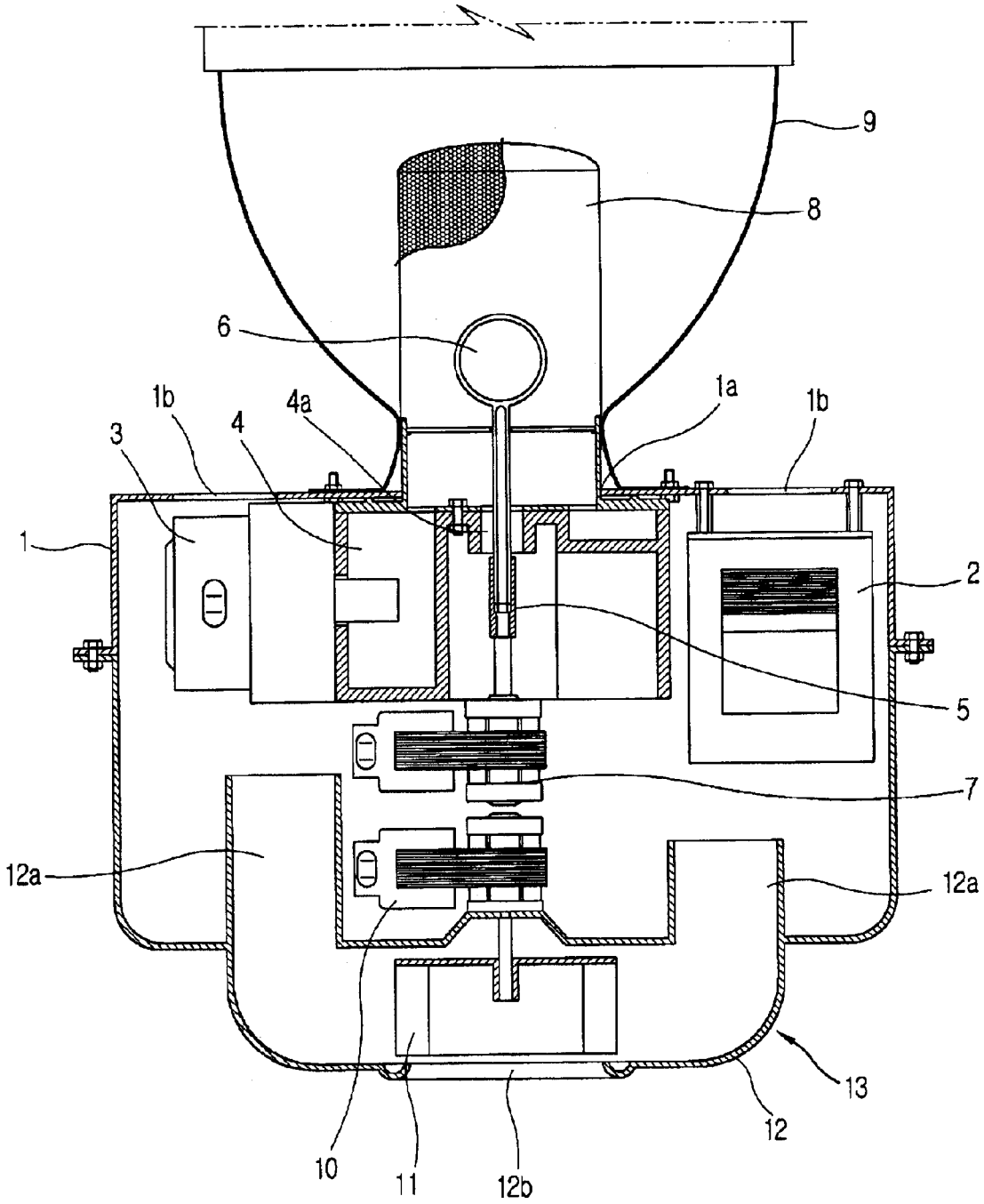
FIG. 1 CONVENTIONAL ART
FIG. 1 is a longitudinal cross-sectional view showing a conventional electrodeless lighting system.
Figure 2:
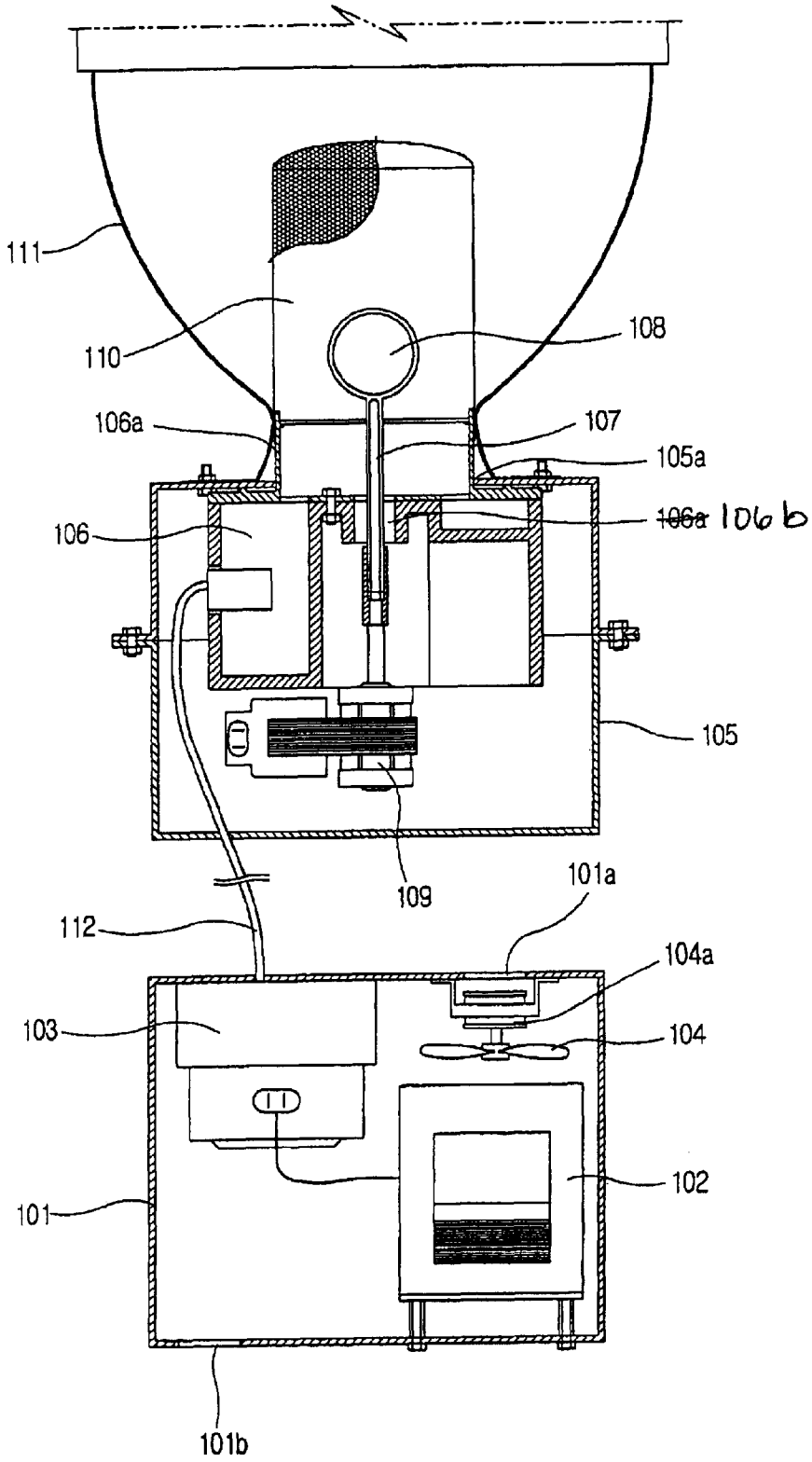
FIG. 2 is a longitudinal cross-sectional view showing an electrodeless lighting system according to an embodiment of the present invention.

FIG. 2 is a longitudinal cross-sectional view showing an electrodeless lighting system according to an embodiment of the present invention.

As shown therein, the electrodeless lighting system comprises a subsidiary case 101 including a high voltage generator 102 for boosting utility AC power to high voltage, a magnetron 103 for generating microwave by the high voltage supplied from the high voltage generator 102, and a cooling fan 104 and fan motor 104*a* for cooling the magnetron 103 and the high voltage generator 102.

The subsidiary case 101 further includes a suction hole 101*a* and a discharge hole 101*b* so that outside air is sucked and discharged when the cooling fan 104 rotates.

The electrodeless lighting system further comprises a main case 105, which is constructed apart from the subsidiary case 101, including a waveguide 106 for guiding the microwave generated from the magnetron 103, and a blub motor 109 for generating rotation force so as to cool down a bulb 108 which will be described later.

Herein, a opening portion 105*a* is formed on an area where a part of the waveguide 106 is protruded through the main case 105, and the other parts of the main case 105 except the opening portion 105*a* are sealed. In addition, the waveguide 106 is fixed in the main case 105, and the bulb motor 109 is installed on bottom portion of the waveguide 106.

An exit portion 106*a* of the waveguide 106 is exposed on front side of the main case 105 through the opening portion 105*a*, and a resonator 110 for blocking the leakage of the microwave and passing the light emitted from the bulb 108 is coupled to the exit portion 106*a*.

Also, a reflector 111 of conical shape, which reflects the light generated from the bulb 108 and passed through the resonator 110, is fixed on front side of the main case 105 around the resonator 110.

The bulb 108 is formed as a circle in which a material emitted by the microwave energy eradiated through the waveguide 106 is filled.

The bulb 108 includes no electrode such as filament, has long or semipermanent life span. In addition, the material filled in the bulb 108 may be metal, halogen compounds, or sulfur and selenium which emits by forming plasma during the operation of the bulb 108, inert gas such as Ar, Xe, Kr for forming plasma inside the bulb 108 at an initial stage of emitting light, and additives for making the lighting to be easy by helping the initial discharge or for controlling spectrum of the generated light. In addition, the kinds, amount, or ratio of these materials are controlled according to the object of the illuminant.

The bulb 108 is generally spherical or cylindrical form, and fabricated by the material of high light transmittance and little dielectric loss such as quartz.

On the other hand, a shaft through hole 106*b* is formed on central portion of the waveguide 106, and a rotation shaft 107 which transmits rotation force from the bulb motor 109 to the bulb 108 passes through the shaft through hole 106*b*.

Especially, a microwave transmission cable 112 is connected between the magnetron 103 installed inside the main case 105 and the waveguide 106 installed inside the subsidiary case 101 so as to transmit the microwave from the magnetron 103 to the waveguide 106.

Operation and effect of the electrodeless lighting system according to the embodiment of the present invention constructed as above will be described as follows.

When electric power is applied to the high voltage generator 102 installed inside the subsidiary case 101, the microwave is outputted from the magnetron 103 by the high voltage generated from the high voltage generator 102.

The outputted microwave is transmitted to the waveguide 106 installed inside the main case 105 through the microwave transmission cable 112, after that, the microwave is radiated to inside of the resonator 110 through the waveguide 106.

At that time, the material filled in the bulb 108 is discharged by the microwave radiated inside the resonator 110 and plasma is generated, and thereby the light is emitted. In addition, the light passes through the resonator 110 and is irradiated to frontward, or a part of the light is reflected on the reflector 111 and irradiated to frontward.

On the other hand, when the light is emitted from the bulb 108, the bulb motor 109 is rotated at a predetermined speed to make the bulb 108 to rotate, and thereby heating and damage of local part on surface of the bulb 108 can be prevented.

Also, the cooling fan 104 is operated in the subsidiary case 101 to cool down the high voltage generator 102 and the magnetron 103.

Therefore, according to the electrodeless lighting system of the above embodiment, the high voltage generator 102 and the magnetron 103 which emits high temperature are installed inside the subsidiary case 101 with the cooling fan 104, and the bulb 108 or the resonator 110 are installed inside the main case 105, whereby the size of the main case is reduced and the lighting system can be installed easily even if the space is small.

Also, the main case 105 is sealed, and therefore the impurities are not infiltrated into the resonator 110 and the waveguide 106, whereby the erosion or the defect of the components can be prevented.

Figure 3:
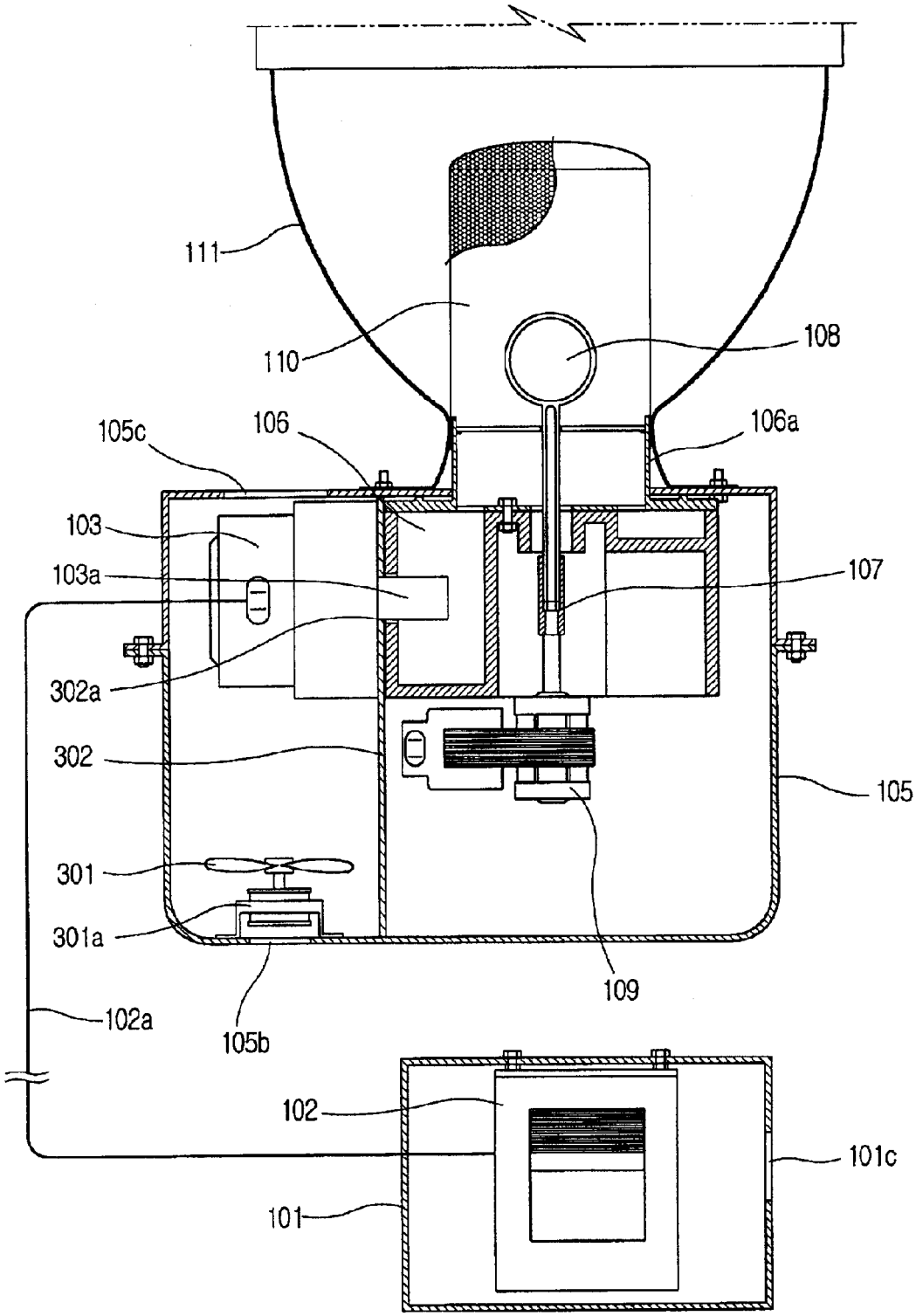
FIG. 3 is a longitudinal cross-sectional view showing an electrodeless lighting system according to another embodiment of the present invention.

FIG. 3 is a longitudinal cross-sectional view showing an electrodeless lighting system according to another embodiment of the present invention. For convenience' sake, same reference numerals as those of the above embodiment are used for components having same functions.

In the above embodiment, the magnetron and the high voltage generator are installed in an additional subsidiary case, however, the high voltage generator is installed in the subsidiary case and the magnetron is installed in the main case according to the present embodiment.

That is, the high voltage generator 102 for transforming the utility AC power into the high voltage is installed in the subsidiary case 101.

Herein, a suction hole 101*c* is formed on one side of the subsidiary case 101 so that the outside air is induced and the high voltage generator 102 can be cooled down.

The main case 105 which is disposed apart from the subsidiary case 101 comprises the magnetron 103 for generating th microwave by connecting to the high voltage generator 102 with the coaxial cable 102*a*, the waveguide 106 for guiding the microwave generated from the magnetron 103, and the bulb motor 109 for generating rotation force so as to cool down the bulb 108.

In addition, the resonator 110 installed on the exit 106*a* of the waveguide 106, the bulb 108, for generating light by the microwave, connected with the bulb motor 109 by the rotation shaft 107 inside the resonator 110, and the reflector 111 for reflecting the light generated in the bulb 108 to the frontward are installed on the front of the main case 105.

Especially, a separating plate 302 for dividing an area where the magnetron 103 is located and an area where the waveguide 106 is located is installed inside the main case 105, and the separating plate 302 includes a hole 302*a* through which an outlet portion 103*a* of the magnetron 103 passes. In addition, a cooling fan 301 and a fan motor 301*a* are installed on the area where the magnetron 103 is located in the main case 105 for cooling down the magnetron 103.

And a suction hole 105*b* and a discharge hole 105*c* are formed on the main case 105 where the magnetron 103 is located so that the outside air is sucked and discharged according to the operation of the cooling fan 301.

In addition, the main case 105 where the waveguide 106 is located is sealed with the separating plate 302.

According to the electrodeless lighting system according to the another embodiment of the present invention, the high voltage generator is installed on an additional subsidiary case, and the area where the waveguide and the resonator are installed is sealed, and therefore the size of the main case can be reduced and the infiltration of the impurities into the area where the waveguide is installed can be prevented.

On the other hand, the cooling fan and the fan motor are installed in order to cool down the high voltage generator or the magnetron in the above embodiments, however, methods such as a natural air convection by forming a hole on the respective cases, and a heat conduction method which radiates heat out of the case by installing heat pipe having higher heat conductivity may be used to cool down the high voltage generator and the magnetron.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system, comprising:

a main case, comprising a waveguide configured to transmit a microwave is therethrough, a resonator coupled to an exit portion of the waveguide, and a bulb located in the resonator;

a subsidiary case, separate from the main case, comprising a magnetron configured to generate the microwave, and high voltage generator configured to provide high voltage power to the magnetron; and a microwave transmission cable configured to connect the magnetron to the waveguide and configured to transmit the microwave from the magnetron to the waveguide.

2. The lighting system of claim 1, wherein the main case is sealed at its outer perimeters except at a portion of the outer perimeter where the exit portion of the waveguide protrudes through the main case.

3. The lighting system of claim 1, wherein the subsidiary case further comprises a cooling device configured to cool the magnetron and the high voltage generator.

4. The lighting system of claim 3, wherein the subsidiary case further comprises at least one suction hole and at least one discharge hole, wherein the at least one suction hole and the at least one discharge hole are configured to circulate outside air provided by the cooling device through the subsidiary case, and wherein the cooling device comprises a cooling fan configured to forcedly circulate outside air throughout the subsidiary case, and a fan motor configured to drive the cooling fan.

5. An electrodeless lighting system, comprising:

a main case comprising a magnetron configured to generate a microwave, a waveguide configured to transmit the microwave therethrough a resonator coupled to an exit of the waveguide, and a bulb located in the resonator;

a subsidiary case, separate from the main case, comprising a high voltage generator configured to provide high voltage power to the magnetron; and a coaxial cable configured to connect the high voltage generator to the magnetron and configured to transmit the high voltage power to the magnetron.

6. The lighting system of claim 5, wherein the main case further comprises a separating plate configured to divide a first area of the main case and a second area of the main case, wherein the magnetron is installed in the first area, and the waveguide is installed in the second area.

7. The lighting system of claim 6, wherein a cooling device is installed on in the first area which is configured to cool the magnetron.

8. The lighting system of claim 7, wherein the first area further comprises at least one suction hole and at least one discharge hole, wherein the at least one suction hole and the at least one discharge hole are configured to circulate outside air provided by the cooling device though the first area, and wherein the cooling comprises a cooling fan configured to circulate outside air throughout the first area, and a fan motor configured to drive the cooling fan.

9. The lighting system of claim 6, wherein the second area is sealed.

10. The lighting system of claim 5, wherein the subsidiary case further comprises a ventilating hole configured to allow outside air into the subsidiary case.

11. The lighting system of claim 1, wherein the main case is configured to inhibit outside contamination from entering the main case.

12. The lighting system of claim 1, wherein the main case and the subsidiary case are configured function at a plurality of positions relative to one another.

13. The lighting system of claim 6, wherein the main case is configured to inhibit outside contamination from entering the main case.

14. The lighting system of claim 6, wherein the main case and the subsidiary case are configured to function at a plurality of positions relative to one another.

15. An electrodeless lighting system, comprising:

a main case having a lighting device; and a subsidiary case separate from the main case and connected to the main case by a microwave transmission cable, wherein the microwave transmission cable is configured to transmit a microwave from the subsidary case to the main case for providing power to the lighting device.

16. The lighting system of claim 15, wherein the main case is configured to house a waveguide configured to transmit a microwave therethrough, a resonator coupled to the exit of the waveguide, and a bulb installed in the resonator.

17. The lighting system of claim 16, wherein the subsidiary case is configured to house a magnetron configured to generate a microwave, and a generator configured to supply high voltage power to the magnetron.

18. The lighting system of claim 17, wherein the subsidiary case further comprises a cooling device configured to cool the magnetron and the generator and wherein the cooling device is configured to circulate outside air induced through a suction hole of the subsidiary case and discharged through a discharge hole the subsidiary case throughout the subsidiary case.

19. The lighting system of claim 18, wherein the cooling device comprises:

a cooling fan configured to forcedly circulate outside air in the subsidiary case; and a fan motor configured to drive the cooling fan.

20. The lighting system of claim 16, wherein the main case is sealed at its outer perimeters except at a portion of the outer perimeter where an exit portion of the waveguide protrudes through the main case.

21. An electrodeless lighting system comprising:

a main case comprising a plate configured to divide the main case into a first area and a second area;

a magnetron installed in the first area of the main case and configured to generate a microwave; and a subsidiary case connected to the main case by a cable, wherein the cable is configured to supply high voltage power to the first area of the main case.

22. The lighting system of claim 21, the main case further comprising:

a waveguide installed in the second area and configured to transmit the microwave generated by the magnetron therethrough;

a resonator coupled to an exit of the waveguide; and a bulb located in the resonator.

23. The lighting system of claim 21, wherein the subsidiary case further comprises a high voltage generator configured to generate high voltage power.

24. The lighting system of claim 21, wherein a cooling device configured to cool the magnetron is installed in the first area, the cooling device comprising:

a cooling fan configured to circulate outside air throughout the first area; and a fan motor configured to drive the cooling fan.

25. The lighting system of claim 24, wherein the first area comprises at least one suction hole and at least one discharge hole, wherein the at least one suction hole and at least one discharge hole are configured to circulate outside air provided by the cooling device through the first area.

26. The lighting system of claim 24, wherein the second area is configured to inhibit outside contamination from entering the second area.

27. The lighting system of claim 21, wherein the main case and the subsidiary case are configured to function at a plurality of positions relative to one another.

28. The lighting system of claim 21, wherein the cable is a coaxial cable.

29. An electrodeless lighting system, comprising:

a main case, comprising a waveguide configured to transmit a microwave therethrough, a resonator coupled to an exit portion of the waveguide, and a bulb located in the resonator;

a subsidiary case, comprising a magnetron configured to generate the microwave, a high voltage generator configured to provide high voltage power to the magnetron, and a cooling device configured to cool the magnetron and the high voltage generator, wherein at least one suction hole and at least one discharge hole provided in the subsidiary case are configured to circulate outside air provided by the cooling device through the subsidiary case; and a microwave transmission cable configured to connect the magnetron to the waveguide and configured to transmit the microwave from the magnetron to the waveguide.

30. The lighting system of claim 29, wherein the cooling device comprises a cooling fan configured to forcedly circulate outside air throughout the subsidiary case, and a fan motor configured to drive the cooling fan.

31. An electrodeless lighting system, comprising:

a main case configured to house a waveguide configured to transmit a microwave therethrough, a resonator coupled to the exit of the waveguide, and a bulb installed in the resonator, wherein the main case is sealed at its outer perimeters except at a portion of the outer perimeter where an exit portion of the waveguide protrudes through the main case so as to inhibit outside contamination from entering the main case; and a subsidiary case connected to the main case by a microwave transmission cable, wherein the microwave transmission cable is configured to transmit a microwave from the subsidiary case to the main case.

32. An electrodeless lighting system comprising:

a main case comprising a plate configured to divide the main case into a first area and a second area;

a magnetron installed in the first area of the main case and configured to generate a microwave;

a cooling device installed in the first area and configured to cool the magnetron, wherein the first area comprises at least one suction hole and at least one discharge hole, and wherein the at least one suction hole and at least one discharge hole are configured to circulate outside air provided by the cooling device through the first area; and a subsidiary case connected to the main case by a cable, wherein the cable is configured to supply high voltage power to the first area of the main case.

33. The lighting system of claim 32, wherein the cooling device comprises:

a cooling fan configured to circulate outside air throughout the first area; and a fan motor configured to drive the cooling fan.

34. The lighting system of claim 32, wherein the second area is configured to inhibit outside contamination from entering the second area.

* * * * *